US012600528B2

(12) United States Patent
Bloom et al.

(10) Patent No.: US 12,600,528 B2
(45) Date of Patent: Apr. 14, 2026

(54) PACKAGE AND CLOSURE FOR PACKAGE

(71) Applicant: BERRY GLOBAL, INC., Evansville, IN (US)

(72) Inventors: Daniel A. Bloom, Bowling Green, OH (US); Kenneth S. Bloom, Bloomdale, OH (US)

(73) Assignee: BERRY GLOBAL, INC., Evansville, IN (US)

( * ) Notice: Subject to any disclaimer, the term of this patent is extended or adjusted under 35 U.S.C. 154(b) by 115 days.

(21) Appl. No.: 18/767,311

(22) Filed: Jul. 9, 2024

(65) Prior Publication Data

US 2025/0019127 A1 Jan. 16, 2025

Related U.S. Application Data

(60) Provisional application No. 63/525,888, filed on Jul. 10, 2023.

(51) Int. Cl.
*B65D 1/10* (2006.01)
*B65D 41/04* (2006.01)
*B65D 47/06* (2006.01)

(52) U.S. Cl.
CPC ..... *B65D 41/0421* (2013.01); *B65D 47/06* (2013.01); *B65D 2251/20* (2013.01)

(58) Field of Classification Search
CPC . B65D 41/0421; B65D 47/06; B65D 2251/20
USPC ..... 220/254.3, 288, 300; 215/237, 329
See application file for complete search history.

(56) References Cited

U.S. PATENT DOCUMENTS

| | | | | |
|---|---|---|---|---|
| 3,891,110 | A * | 6/1975 | Gach | B65D 50/046 215/221 |
| 2001/0019033 | A1 | 9/2001 | Montgomery | |
| 2002/0079282 | A1 * | 6/2002 | Harrold | B65D 47/0809 222/153.07 |
| 2005/0023285 | A1 | 2/2005 | Keung | |
| 2009/0045224 | A1 * | 2/2009 | Faaborg | B65D 41/0471 215/44 |
| 2014/0263151 | A1 | 9/2014 | Russell | |
| 2019/0071225 | A1 * | 3/2019 | Bertram | B65D 1/10 |
| 2020/0055638 | A1 | 2/2020 | Lau | |

OTHER PUBLICATIONS

International (PCT) Search Report for PCT/US2024/037188 dated Oct. 18, 2024, BP-615 PCT || 13 pages.

* cited by examiner

*Primary Examiner* — Don M Anderson
*Assistant Examiner* — Elizabeth J Volz
(74) *Attorney, Agent, or Firm* — Barnes & Thornburg LLP

(57) ABSTRACT

A package includes a container and a closure. The container includes a container body having a sidewall and a floor coupled to a lower end of the sidewall and a filler neck coupled to an upper end of the sidewall and spaced apart from the floor. The closure includes a top wall formed to include a product-dispensing outlet and an annular skirt coupled to the top wall and extending in a downward direction away from the top wall. The product-dispensing outlet can be oriented toward a side of the container.

20 Claims, 6 Drawing Sheets

PACKAGE AND CLOSURE FOR PACKAGE

PRIORITY CLAIM

This application claims priority under 35 U.S.C. § 119(e) to U.S. Provisional Patent Application No. 63/525,888, filed Jul. 10, 2023, which is expressly incorporated by reference herein in its entirety.

BACKGROUND

The present disclosure relates to containers, and particularly to a closure for a container. More particularly, the present disclosure relates to a closure configured to be screwed onto a container.

SUMMARY

According to the present disclosure, a package includes a container and a closure. The container includes a container body having a sidewall and a floor coupled to a lower end of the sidewall and a filler neck coupled to an upper end of the sidewall and spaced apart from the floor. The closure includes a top wall formed to include a product-dispensing outlet and an annular skirt coupled to the top wall and extending in a downward direction away from the top wall.

In illustrative embodiments, the container further includes a closure anchor unit coupled to the filler neck. The closure anchor unit includes an exterior thread, a first closure anchor, and a second closure anchor. The exterior thread is coupled to an exterior surface of the filler neck and having a first end and a second end spaced apart from the first end in a vertical direction. The first closure anchor is coupled to the exterior surface of the filler neck and is located circumferentially between the first end and the second end. The second closure anchor is aligned with the first closure anchor in the vertical direction and spaced apart from the first closure anchor in a circumferential direction to reside on an opposite side of the filler neck from the first closure anchor.

In illustrative embodiments, the closure further includes a closure retainer unit coupled to the annular skirt. The closure retainer unit includes an interior thread, a first closure retainer, and a second closure retainer. The interior thread is coupled to an inner surface of the annular skirt and is configured to engage with the exterior thread during installation of the closure on the filler neck of the container. The first closure retainer is configured to engage with the first closure anchor to block rotation of the closure relative to the filler neck. The second closure retainer is configured to engage with the second closure anchor to block rotation of the closure relative to the filler neck.

In illustrative embodiments, the product-dispensing outlet is offset from a central axis of the closure toward the first closure retainer and the first closure anchor. This aligns the product-dispensing outlet with the first closure retainer and the first closure anchor at a predetermined circumferential orientation relative to the container when the closure is installed on the container.

In illustrative embodiments, the closure anchor unit further includes a plurality of recesses coupled to the exterior surface of the filler neck and spaced apart circumferentially from the first closure anchor and the second anchor. In illustrative embodiments, the closure retainer unit further includes a plurality of projections coupled to the inner surface of the annular skirt and spaced apart circumferentially from the first closure retainer and the second closure retainer. Each projection is configured to extend into a respective recess when the closure is installed on the container.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 5:
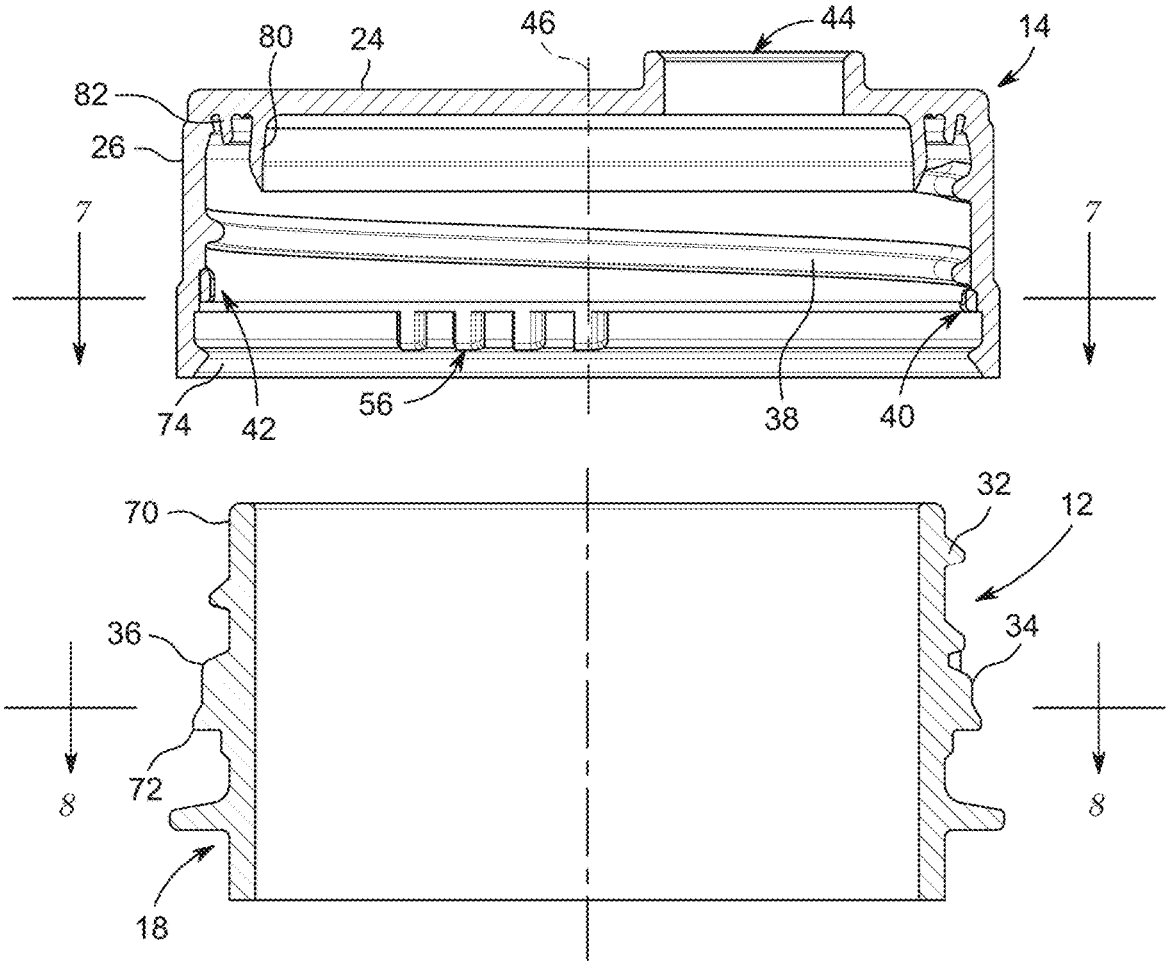
Figure 6:
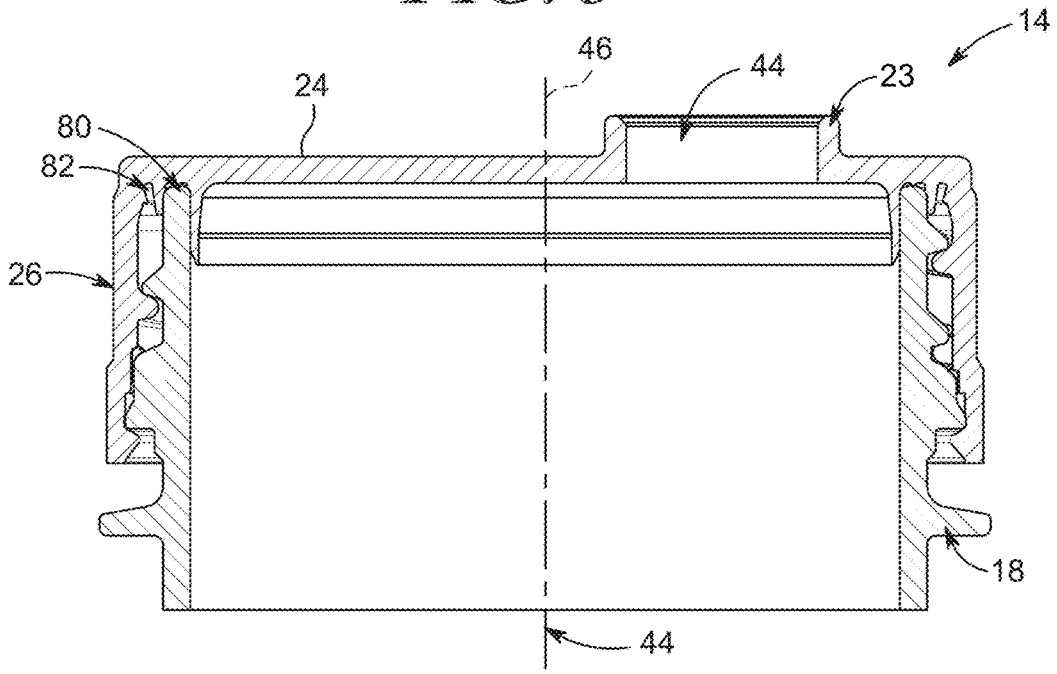
Figure 7:
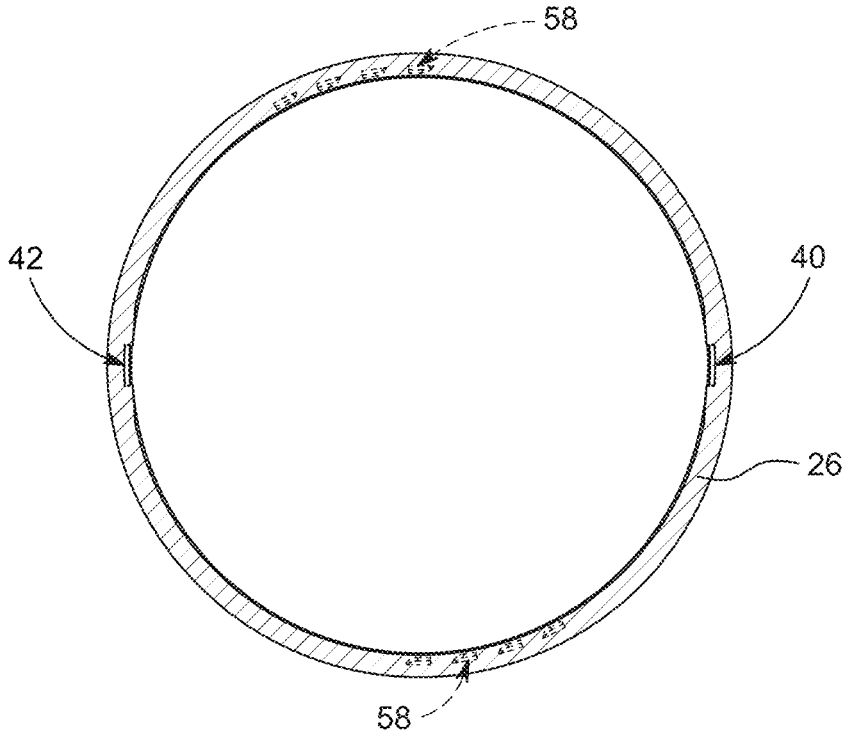
Figure 8:
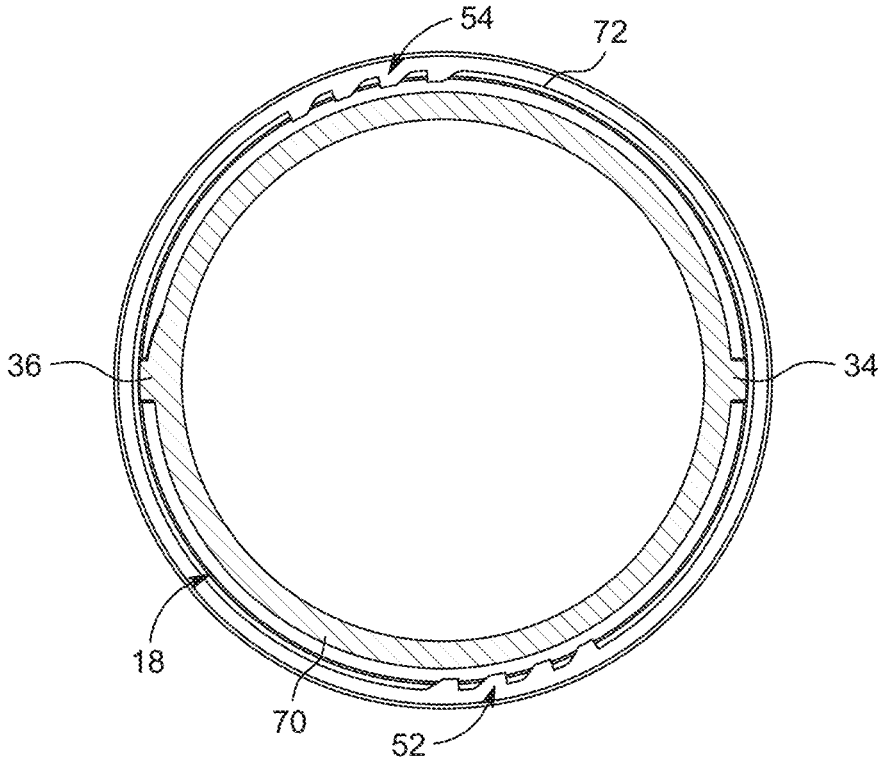
Figure 9:
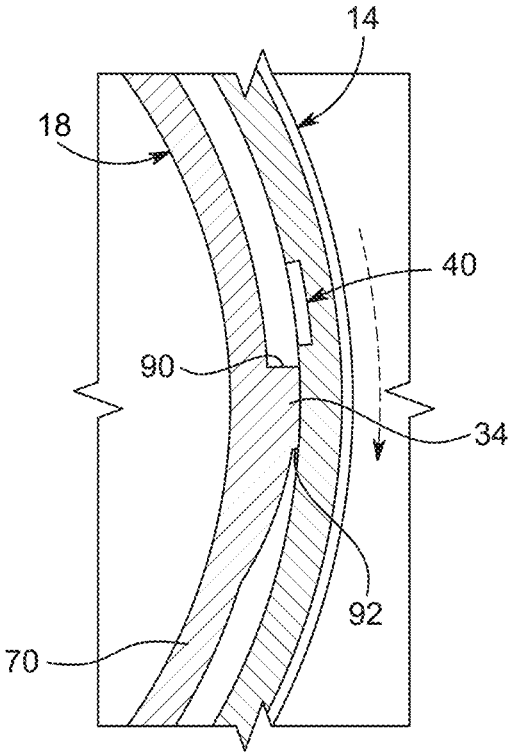
Figure 10:
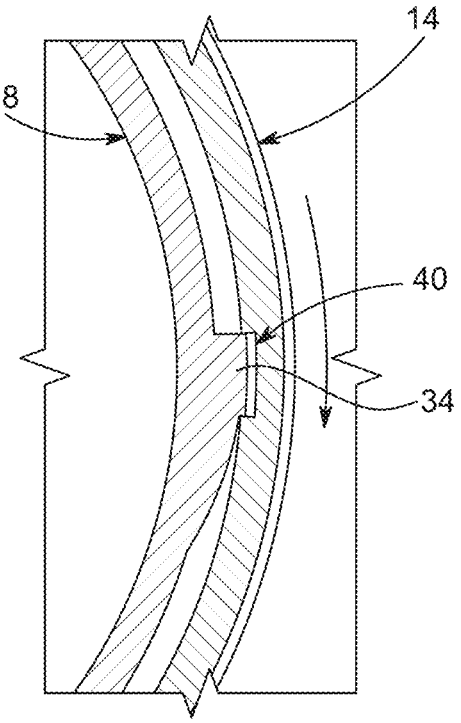
Figure 11:
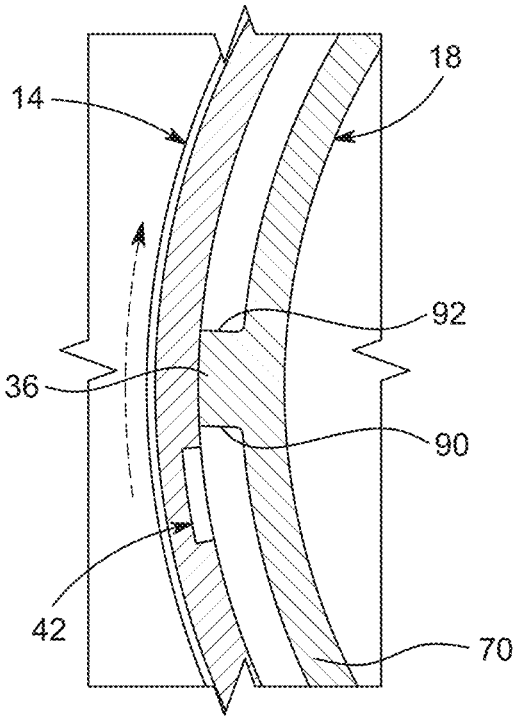
Figure 12:
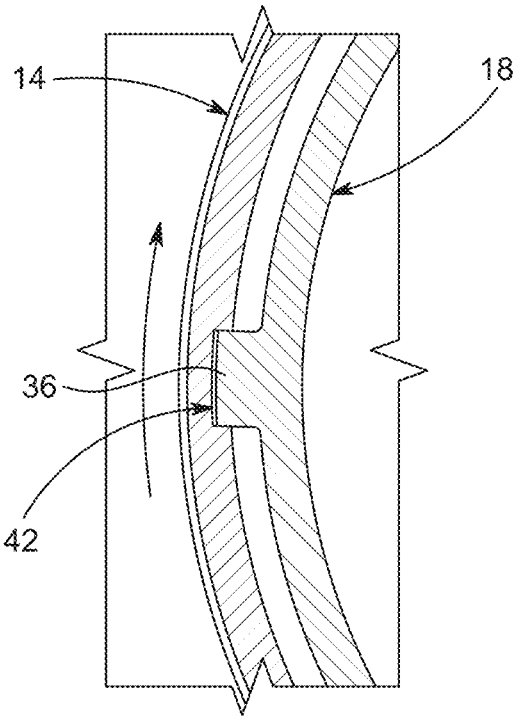
Figure 13:
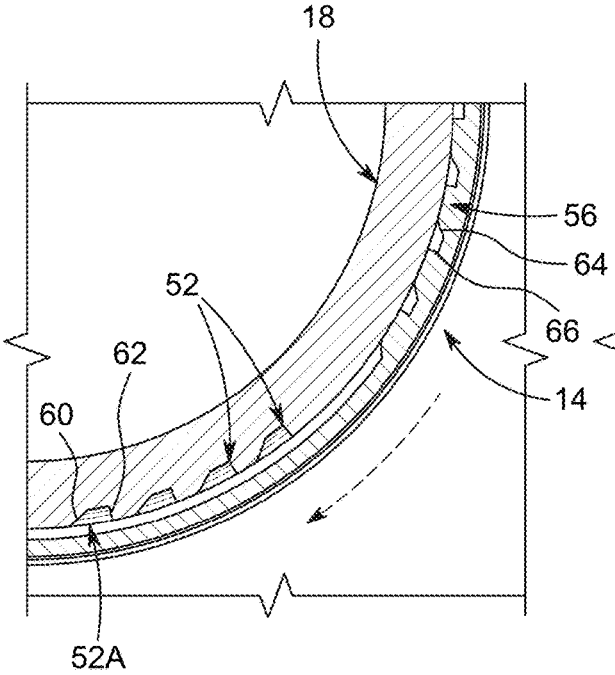
Figure 14:
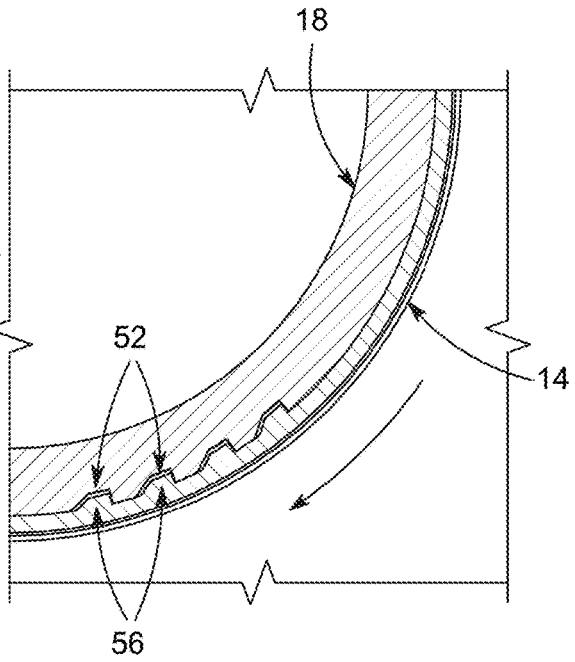
Figure 15:
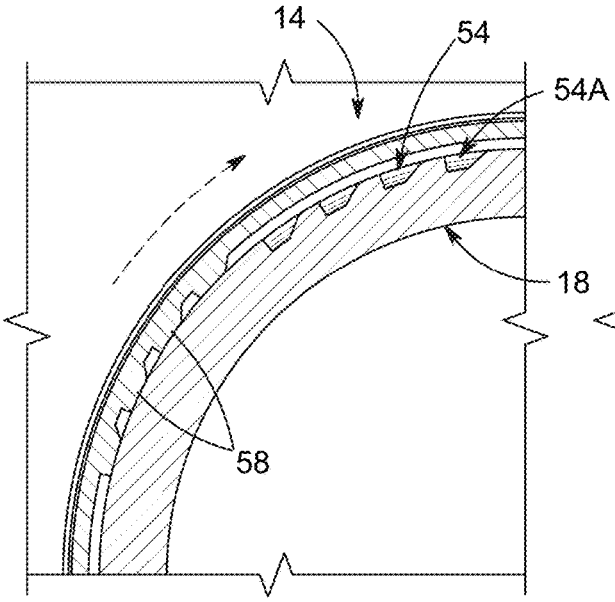
Figure 16:
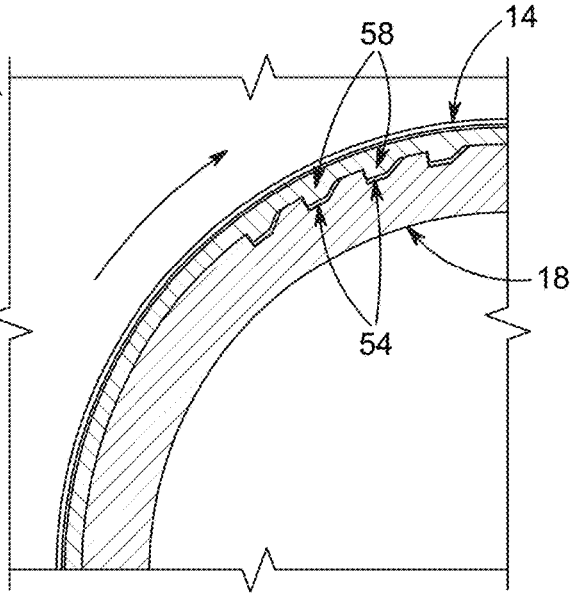

FIG. 5 is a cross section and exploded assembly view of the filler neck of the container and the closure showing that the container includes a closure anchor unit and the closure includes a closure retainer unit configured to interact with the closure anchor unit during installation of the closure on the filler neck of the container to orient that product-dispensing outlet toward the selected side of the container;

FIG. 6 is a cross section of the filler neck and the closure installed on the filler neck;

FIG. 7 is a cross section of the closure taken along line 7-7 in FIG. 5 showing that the closure retainer unit includes a first closure retainer, a second closure retainer spaced circumferentially about 180 degrees from the first closure retainer, a first set of projections spaced circumferentially about 90 degrees from the first and second closure retainers, and a second set of projections spaced circumferentially about 180 degrees from the first set of projections;

FIG. 8 is a cross section of the filler neck taken along line 8-8 in FIG. 5 showing that the closure anchor unit includes a first closure anchor, a second closure anchor spaced circumferentially about 180 degrees from the first closure anchor, a first set of recesses spaced circumferentially about 90 degrees from the first and second closure anchors, and a second set of recesses spaced circumferentially about 180 degrees from the first set of recesses;

FIG. 9 is an enlarged cross section of a portion of the closure and the filler neck showing the first closure anchor and the first closure retainer spaced circumferentially from one another prior to full installation of the closure on the filler neck;

FIG. 10 is an enlarged cross section of a portion of the closure and the filler neck showing the first closure anchor and the first closure retainer coupled to one another to provide full installation of the closure on the filler neck and block rotation of the closure relative to the filler neck;

FIG. 11 is an enlarged cross section of a portion of the closure and the filler neck showing the second closure anchor and the second closure retainer spaced circumferentially from one another prior to full installation of the closure on the filler neck;

FIG. 12 is an enlarged cross section of a portion of the closure and the filler neck showing the second closure anchor and the second closure retainer coupled to one another to provide full installation of the closure on the filler neck and block rotation of the closure relative to the filler neck;

FIG. 13 is an enlarged cross section of a portion of the closure and the filler neck showing the first set of projections and the first set of recesses spaced circumferentially from one another prior to full installation of the closure on the filler neck;

FIG. 14 is an enlarged cross section of a portion of the closure and the filler neck showing the first set of projections received in the first set of recesses to provide full installation of the closure on the filler neck and block rotation of the closure relative to the filler neck;

FIG. 15 is an enlarged cross section of a portion of the closure and the filler neck showing the second set of projections and the second set of recesses spaced circumferentially from one another prior to full installation of the closure on the filler neck; and FIG. 16 is an enlarged cross section of a portion of the closure and the filler neck showing the second set of projections received in the second set of recesses to provide full installation of the closure on the filler neck and block rotation of the closure relative to the filler neck.

DETAILED DESCRIPTION

Figure 1:
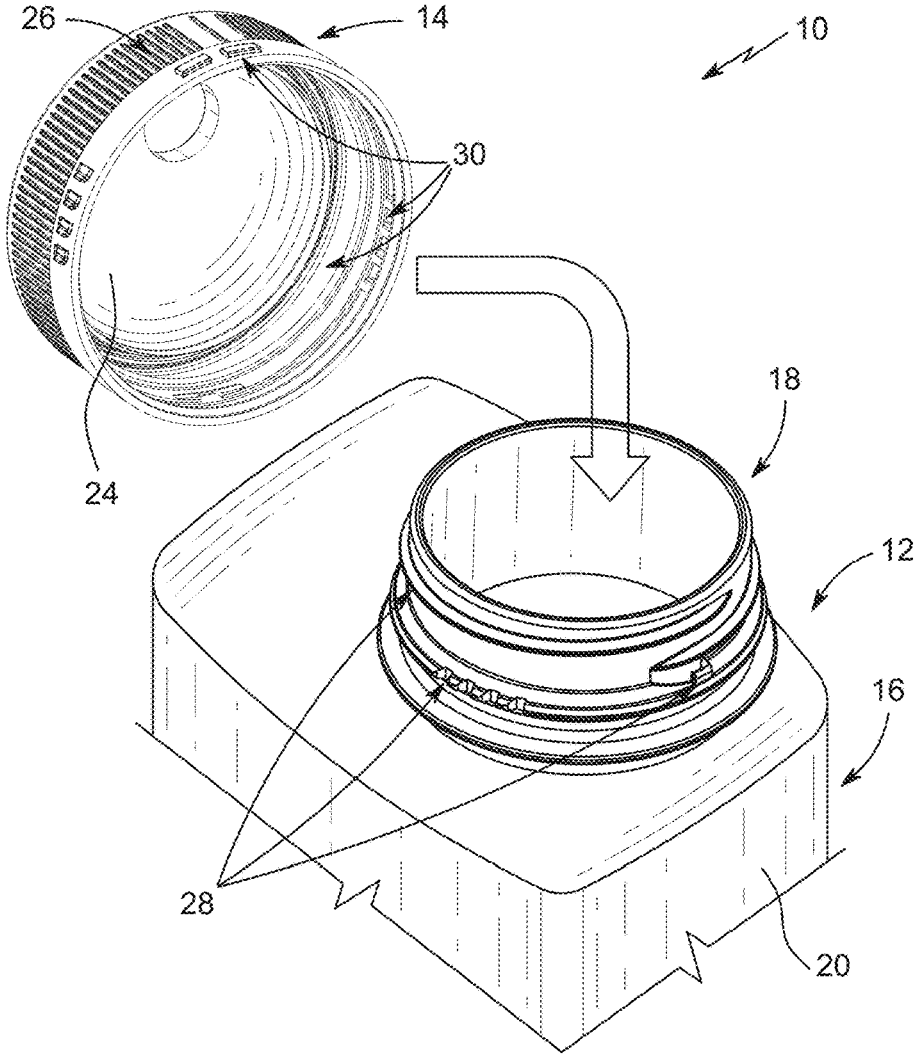
FIG. 1 is a perspective view of a package in accordance with the present disclosure including a container and a closure separated from the container and configured to couple with a filler neck of the container.
Figure 2:
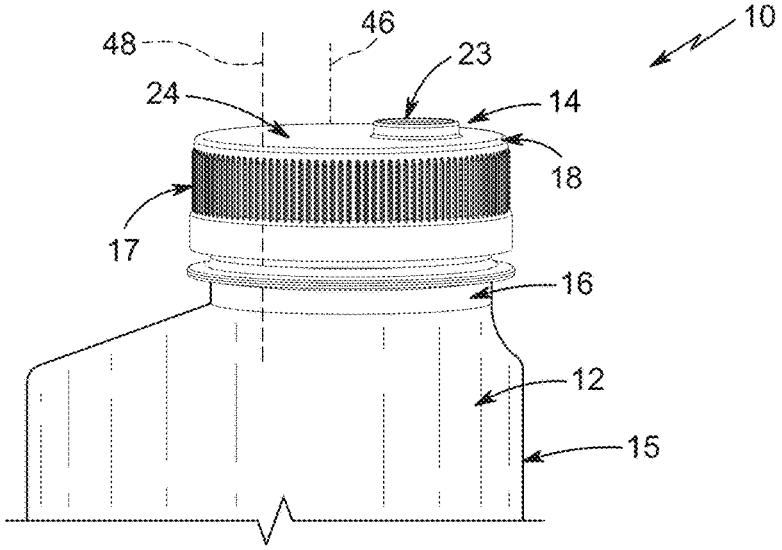
FIG. 2 is a side view of the package showing that the closure includes a top wall and an annular skirt arranged to extend downwardly from the top wall, and showing that the top wall is formed to include a product-dispensing outlet offset from a central axis of the closure.
Figure 3:
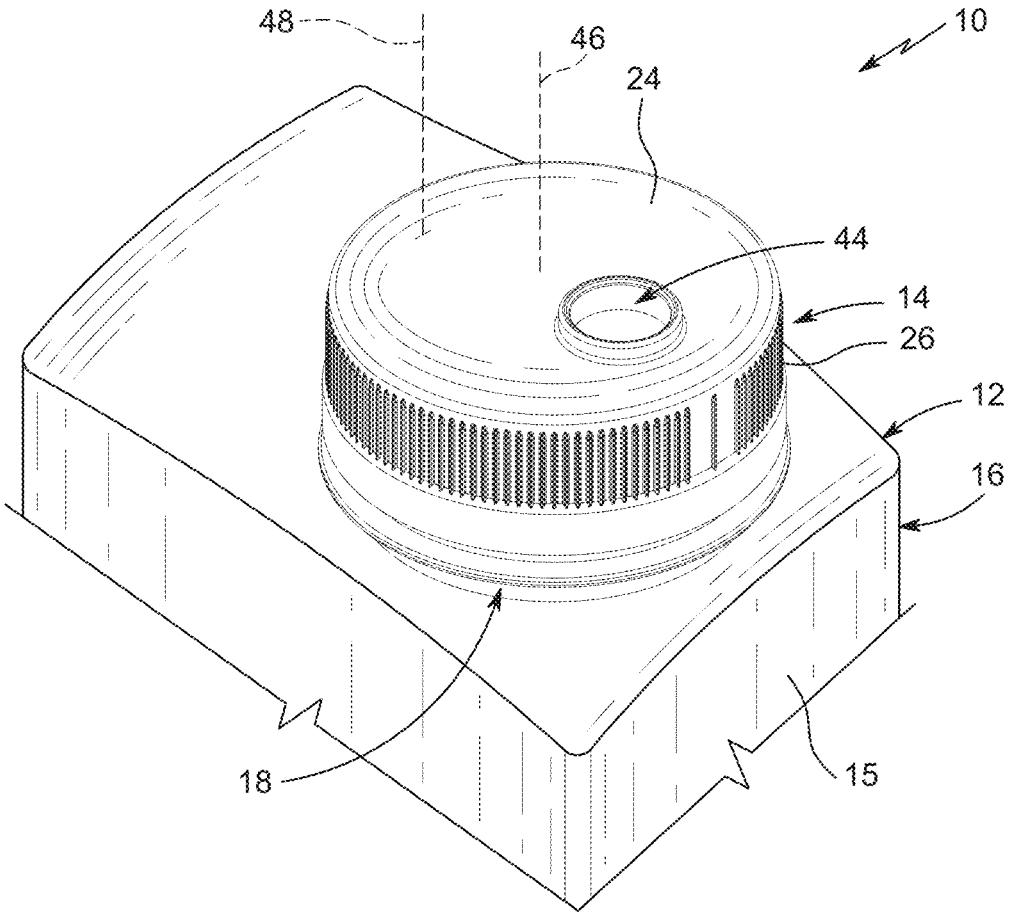
FIG. 3 is a perspective view of the package showing the closure mounted on the container in a predetermined orientation where the product-dispensing outlet is oriented toward a selected side of the container.

A package 10 includes a container 12 and a closure 14 configured to be coupled with the container 12 as shown in FIG. 1. The container 12 includes a container body 16 and a filler neck 18 coupled to an upper end of the container body 16. The container body 16 includes a sidewall 20 and a floor 22 coupled to a lower end of the sidewall 20. The closure 14 is configured to be attached to the filler neck 18 of the container 12 and includes a top wall 24 and an annular skirt 26 extending in a downward direction from the top wall 24 and configured to engage with the filler neck 18 to mount the closure 14 to the container 12.

In the illustrative embodiment, the container 12 further includes a closure anchor unit 28 coupled to the filler neck 18. The closure 14 further includes a closure retainer unit 30 coupled to the annular skirt 26. The closure anchor unit 28 and the closure retainer unit 30 are configured to interact with one another to retain the closure 14 on the container 12 and orient the closure 14 relative to the container 12 in a predetermined orientation.

The closure anchor unit 28 is coupled to an exterior surface of the filler neck 18 and includes an exterior thread 32, a first closure anchor 34, and a second closure anchor 36. The exterior thread 32 has a first end and a second end spaced apart from the first end in a vertical direction and wraps around a circumference of the filler neck 18 at least 360 degrees. The first closure anchor 34 is coupled to the exterior thread 32 and is located circumferentially between the first end and the second end of the exterior thread 32. The second closure anchor 36 is aligned with the first closure anchor 34 in the vertical direction and is spaced apart from the first closure anchor 34 in a circumferential direction to reside on an opposite side of the filler neck 18 from the first closure anchor 34.

The closure retainer unit 30 is coupled to an interior surface of the annular skirt 26 and includes an interior thread 38, a first closure retainer 40, and a second closure retainer 42. The interior thread 38 is configured to engage with the exterior thread 32 during installation of the closure 14 on the filler neck 18 of the container 12. The first closure retainer 40 is configured to engage with the first closure anchor 34 to block rotation of the closure 14 relative to the filler neck 18. The second closure retainer 42 is configured to engage with the second closure anchor 36 to block rotation of the closure 14 relative to the filler neck 18.

The top wall 24 of the closure 14 is formed to include a product-dispensing outlet 44. The product-dispensing outlet 44 is offset from a central axis 46 of the closure 14 and a central axis 48 of the container 12. The product-dispensing outlet 44 is oriented by the closure anchors 34, 36 and the closure retainers 40, 42 toward the first closure retainer 40 and the first closure anchor 34 to align the product-dispensing outlet 44 with the first closure retainer 40 and the first closure anchor 34 at a predetermined circumferential orientation relative to the container 12.

The closure anchors 34, 36 and the closure retainers 40, 42 interlock with one another to orient the product-dispensing outlet 44 toward a side 15 of the container when the closure 14 is fully installed on the filler neck 18. This may allow contents within the container 12 to be more efficiently released from the container 12 when the package 10 is tilted toward the side 15, for example. The package 10 may also be a cartridge loaded into a device that uses the contents in the container 12. Thus, the closure anchor unit 28 and the closure retainer unit 30 may orient the product-dispensing outlet 44 at a predetermined orientation for use with the device. In some embodiments, the closure anchor unit 28 and the closure retainer unit 30 are configured to substantially inhibit removal of the closure 14 from the container 12 after the closure 14 is installed. This can be for tamper evident purposes, to help protect the contents within the container 12, and/or block unauthorized removal of the contents from the container 12.

The closure anchor unit 28 further includes a first set of recesses 52 coupled to the exterior surface of the filler neck 18 and a second set of recesses 54 coupled to the exterior surface of the filler neck 18. Each of the recesses included in both the first and second sets of recesses 52, 54 is spaced apart circumferentially from the first closure anchor 34 and the second closure anchor 36. Each recess included in the first set of recesses 52 is spaced circumferentially from each recess included in the second set of recesses 54. In the illustrative embodiment, the first and second sets of recesses 52, 54 are each about 90 degrees from both the first closure anchor 34 and the second closure anchor 36. One of the sets of recesses 52, 54 can be omitted in some embodiments. In some embodiments, the first and/or second sets of recesses 52, 54 are the only recesses formed in to the filler neck 18.

The closure retainer unit 30 further includes a first set of projections 56 coupled to the inner surface of the annular skirt 26 and a second set of projections 58 coupled to the inner surface of the annular skirt 26. Each projection included in both the first and second sets of projections 56, 58 are spaced apart circumferentially from the first closure retainer 40 and the second closure retainer 42. Each projection included in the first set of projections 56 are configured to extend into a respective recess included in the first set of recesses 52 when the closure 14 is installed on the container 12. Each projection included in the second set of projections 58 are configured to extend into a respective recess included in the second set of recesses 54 when the closure 14 is installed on the container 12. In the illustrative embodiment, the first and second sets of projections 56, 58 are each about 90 degrees from both the first closure retainer 40 and the second closure retainer 42 to coincide with the first and second sets of recesses 52, 54 when the closure 14 is installed. One of the sets of projections 56, 58 can be omitted in some embodiments along with the corresponding set of recesses. In some embodiments, the first and/or second sets of projections 56, 58 are the only projections formed in to the filler neck 18 aside from the closure retainer(s) 40, 42.

The first and second sets of recesses 52, 54 and the first and second sets of projection 56, 58 are located below the first and second closure anchors 34, 36 and below the first and second closure retainers 40, 42 relative to the top wall 24. Each recess included in the first and second sets of recesses 52, 54 is defined at least partially by a ramped surface 60 and a radial surface 62. The ramped surfaces 60 are angled relative to the exterior surface of the filler neck 18 to extend in a closure-installation direction and allow movement of the closure 14 relative to the filler neck 18 in the closure-installation direction. The radial surfaces 62 are arranged to extend radially outward away from and perpendicular to the exterior surface of the filler neck 18. Each projection included in the first and second sets of projections 56, 58 includes a ramped surface 64 and a radial surface 66. The ramped surfaces 64 are angled to the interior surface of the annular skirt 26 to extend in the closure-installation direction and to engage with and slide along the ramped surface 60 of at least one recess during installation of the closure 14 on the container 12. The radial surfaces 66 are arranged to extend radially inward away from and perpendicular to the interior surface of the annular skirt 26 to engage with the radial surface 62 of one of the recesses after installation of the closure 14 on the container 12 to block rotation of the closure 14 in a removal direction opposite the closure-installation direction.

A first recess 52A included in the first set of recesses 52 is spaced 90 degrees from the first and second closure anchors 34, 36. All other recesses included in the first set of recesses 52 are spaced less than 90 degrees from the first closure anchor 34 and greater than 90 degrees from the second closure anchor 36. A first recess 54A included in the second set of recesses 54 is spaced 90 degrees from the first and second closure anchors 34, 36. All other recesses included in the second set of recesses 54 are spaced less than 90 degrees from the second closure anchor 36 and greater than 90 degrees from the first closure anchor 34. This arrangement provides a ratchetting feature for the closure 14 during installation where the first and second sets of projections 56, 58 engage corresponding recesses 52, 54 in series as the closure 14 is installed prior to the closure retainers 40, 42 engaging the closure anchors 34, 36.

The closure 14 is configured to change from an uninstalled configuration, to a partially-installed configuration, and then to a fully-installed configuration. In the uninstalled configuration, the closure 14 is unscrewed from the filler neck 18 and/or separated from the filler neck 18 of the container 12. In the partially-installed configuration, the closure 14 is at a first angular orientation relative to the filler neck 18 in which at least one of the projections 56, 58 extends into a corresponding recess 52, 54 and the closure retainers 40, 42 are spaced circumferentially from the closure anchors 34, 36. In the fully-installed configuration, the closure 14 is at a second angular orientation relative to the filler neck 18 in which each projection 56, 58 extends into a corresponding recess 52, 54 and the closure retainers 40, 42 engage the closure anchors 34, 36.

The closure anchor unit 28 and the closure retainer unit 30 are configured to provide tactile feedback to a user or device installing the closure 14 on the container 12. The tactile feedback can be a physical or audible sensation. For example, when the projections 56, 58 interact with the recesses 52, 54, a vibration or click may be produced. The tactile feedback may be used to indicate to a user installing the closure 14 on the container 12 that the closure 14 is nearing or at full installation. The projections 56, 58 and recesses 52, 54 may provide a first tactile sensation while the closure anchors 34, 36 and retainers 40, 42 provide a second tactile sensation different than the first tactile sensation. For example, the projections 56, 58 and recesses 52, 54 may provide a first vibration or click while the closure anchors 34, 36 and retainers 40, 42 provide a second vibration or click at a higher level or magnitude than the first vibration or click. In this way the closure anchors 34, 36 and retainers 40, 42 can indicate when full installation of the closure 14 is achieved.

The filler neck 18 includes a neck body 70 coupled to the upper end of the container body 16 and a neck ring 72 coupled to an exterior surface of the neck body 70. The neck body 70 extends in an upward direction from the container body 16 to a top end of the filler neck 18. The neck ring 72 is located between the container body and the top end of the filler neck 18 and below the exterior thread 32. The neck ring 72 is arranged to extend annularly around the neck body 70 and to engage the annular skirt 26 of the closure 14 when the closure 14 is installed on the filler neck 18. The neck ring 72 is configured to block deformation of the annular skirt 26 relative to the container 12 when the closure 14 is installed on the container 12. This blocks unwanted separation of one or more of the closure retainers 40, 42 from the closure anchors 34, 36 and/or the projections 56, 58 from the recesses 52, 54 so that the closure is substantially inhibited from separating from the container 12 after being installed. The neck ring 72 also engages a lower flange 74 included in the annular skirt 26 to deform the annular skirt 26 radially outward during installation of the closure on the filler neck 18 to provide clearance for the first and second closure retainers 40, 42 to move around the closure anchors 34, 36.

The first and second sets of recesses 52, 54 are formed in the neck ring 72 of the filler neck 18. The first and second sets of recesses 52, 54 span a first circumferential length around the filler neck 18 and the first and second sets of projections 56, 58 span a second circumferential length around annular skirt 26. The first and second circumferential lengths are about the same and are less than half of a circumference of both the filler neck 18 and the annular skirt 26. In the illustrative embodiment, the first and second circumferential lengths are less than a quarter of a circumference of both the filler neck 18 and the annular skirt 26. In the illustrative embodiment, each set of recesses 52, 54 includes four recesses and each set of projections 56, 58 includes four projections to correspond with the number of recesses. In other embodiments, any number of recesses and corresponding projections can be used. In some embodiments, the recesses 52, 54 are formed on the annular skirt 26 and the projections are formed on the neck ring 72.

The closure anchors 34, 36 each include a tab that projects outwardly from the exterior surface of the neck body 70. Each of the closure anchors 34, 36 is coupled to an upper end of the neck ring 72 to reside above the plurality of recesses 52, 54. Each closure anchor 34, 36 has a first circumferential end 90 and a second circumferential end 92 opposite the first circumferential end 90. The circumferential ends 90, 92 each extend radially outward away from the neck body 70 and are perpendicular to the exterior surface of the filler neck 18.

The closure retainers 40, 42 each include a notch formed into the inner surface of the annular skirt 26 of the closure 14. Each notch has a circumferential length that is about equal to a width of each corresponding closure anchor 34, 36. The circumferential ends 90, 92 of each corresponding closure anchor 34, 36 abut against circumferential surfaces defining each notch to block rotation of the closure 14 about the central axis 46. The notches are located below the interior thread 38 and above the projections 56, 58.

Closure 14 is configured to be coupled to neck 18 of container 12, as shown, for example in FIG. 1. Closure 14 and container 12 are designed to be coupled together so that closure 14 is always oriented in the same position on the container. For example, closure 14 may be provided such that it includes a dispensing outlet 44 that is opposite a pouring handle (e.g., on a milk jug), adjacent a display panel on a flat side 15, and/or adjacent flat side 15 to facilitate dispensing. The closure 14 and neck 18 are designed so that closure 14 will always end up in the same orientation on container 12 as the closure 14 is screwed onto container 12.

Figure 4:
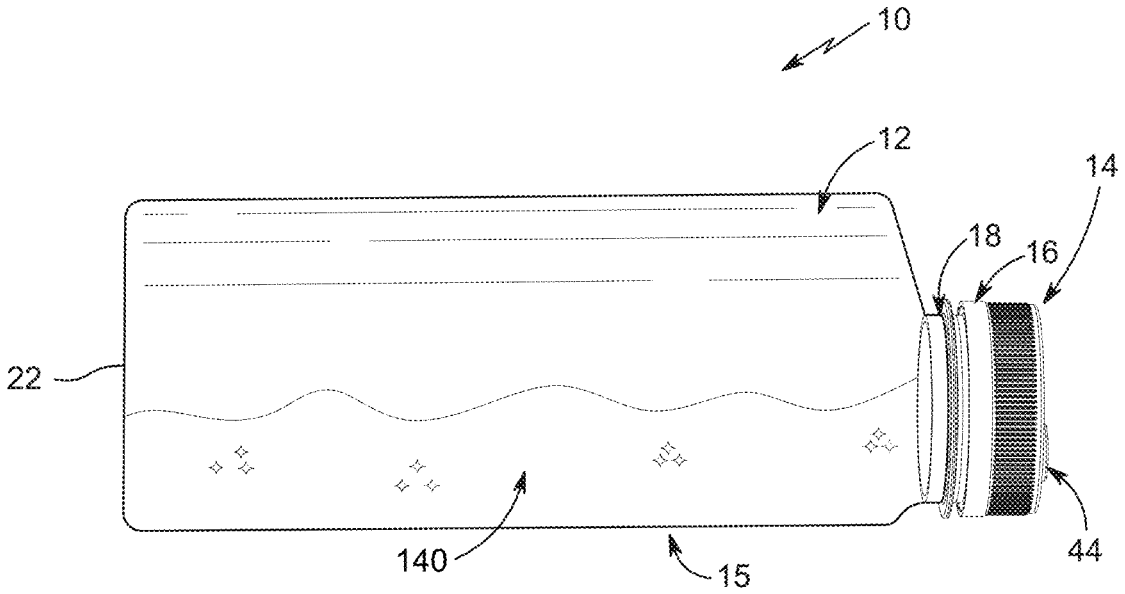
FIG. 4 is a side view of the package tilted toward the selected side and with a portion of the container hidden to show contents within the container flowing toward the product-dispensing outlet.

Closure 14 includes a top wall 24 and an annular skirt 26 that extends downwardly from top wall 24, as shown in FIGS. 1 and 4. Exterior surface of skirt 26 includes a series of closely spaced ribs or knurls 17 that extend around skirt 26. Ribs 17 assist a user when installing closure 14 onto container 12. An annular ring 23 may be located on top wall 24 offset from the center line 44 of closure 14, as shown in FIG. 4. Annular ring 23 may define an opening or dispensing outlet 44 through top wall 24 of closure 14. Locating the dispensing outlet 44 offset from center may facilitate aligning dispensing outlet relative to a side of the container such as a front or display panel and/or to facilitate dispensing contents 140 from container 12, for example, when container 12 is oriented such that it is resting on a flat or bottom side 15. Flat side 15 may be other than flat and/or may be used to provide a logo, information, visual indicia, display panel, or the like.

A device or mechanism may be additionally included in order to further seal or close dispensing outlet 44 and/or annular ring 23. For example, a seal such as a flexible seal (e.g., elastomeric, silicon, TPE, and/or the like) may be inserted into opening 44. Instead of or in addition to a seal being inserted into opening 44, a cap or cover may be provided to cover opening 44. For example, a hinged lid may be added to or included with cover 10, which may facilitate selectively opening and closing opening 44, for example, with a plug fit type arrangement with annular ring 23. In some embodiments, closure 14 may be oriented relative to neck 18 or container 12 for reasons other than location of dispensing outlet 44, such as if a hinge is used, for example. In these or other embodiments, dispensing outlet 44 may be centered or uncentered on closure 14 and/or closure 14 may be oriented in a certain or predetermined position when fully attached to orient a feature other than dispensing outlet 44 relative to neck 18 and/or container 12, such as a hinge or any other feature or combination of features.

Top wall 24 of closure 14 is configured to seal off the opening formed in neck 18 of container 12, as shown in FIG. 4. Top wall 24 may include plug seals 80, 82 that create a seal between closure 14 and neck 18 of container 12 to prevent contents of container 12 from leaking out of interface between closure 14 and container 12. It is understood that plug seals 80, 82 are optional. Top wall 24 may include other linerless type sealing mechanisms such as crab claws and/or V-seals, and/or top wall 24 may be configured for a liner seal. As shown in FIG. 5, opening 44 may be offset from center toward one side of skirt 26. Closure 14 may be configured such that when fully attached to container 12, opening 44 is proximate flat or bottom annular skirt 15 of container 12 as discussed more below.

Skirt 26 of closure 14 includes an inner surface that is provided with a thread segment 38. Thread segment 38 matches thread segment 32 formed on an exterior surface 62 of neck 18 of container 12. Thread segment 38 may start and terminate proximate the same circumferential location while at a different axial position on skirt 26. For example, if thread segment 38 starts at the 12 o'clock position, the thread segment 38 may terminate proximate the 12 o'clock position. Such an arrangement would allow for approximately 360 degrees of rotation from beginning the threaded engagement of closure 14 with neck 18 to final threaded engagement. It is understood that, while 360 degrees of rotation might provide complete circumferential engagement at a relatively minimal level of threading and/or rotation needed, more or less than 360 degrees of threading and/or rotation may be provided in other embodiments.

Skirt 26 may also include at least one catch or retainer 40, 42. For example, skirt 26 may include two catches 40, 42 spaced approximately 180 degrees apart. Catch 40 is configured to engage with a rotation stop block or anchor 34 formed on neck 18 adjacent to the start of thread segment 32. For example, neck 18 may include two stop blocks 34, 36 approximately 180 degrees apart, which may correspond to the two catches 40, 42 such that both catches 40, 42 grip both stop blocks 34, 36 simultaneously when the closure 14 is fully threaded onto neck 18. Catch(es) 40, 42 and stop block(s) 34, 36, when engaged with each other, stop the closure 14 in a predetermined position with respect to container 12 so that closure 14 is properly aligned with container 12.

Skirt 26 may also include projections 56, 58. Projections 56, 58 are configured to engage with recesses 52, 54 formed on a flange or neck ring 72 of neck 18 to lock closure 14 onto container 12 so that closure 14 cannot easily be removed from container 12. One or more projections 56, 58 or groups of projections 56, 58 may be located in more than one location on skirt 26, for example, two groups of projections 56, 58 may be located approximately 180 degrees apart and/or may correspond to two groups of recesses 52, 54 also located approximately 180 degrees apart on neck 18 to correspondingly engage when the closure is fully threaded or closed on neck 18. While four projections 56, 58 and four recesses 52, 54 are shown, it is understood that more or less may be included in each group and that more or less than two groups may be included on closure 14 and/or neck 18. Projections 56, 58 may be angled or have a cam surface on one side and/or recesses 52, 54 may be separated by ribs or walls that are angled or have a cam surface on one side to facilitate attachment of the closure into a locked or secured position in which projections 56, 58 are rotated (e.g., clockwise) past the cam surfaces into a locked position. Projections 56, 58 and/or recesses 52, 54 may have a relative straight surface opposite the cam surface to lock projections 56, 58 into recesses and/or to prevent removal rotation (e.g., counter-clockwise) of closure 14 relative to neck 18.

When closure 14 is coupled to container 12, closure 14 is located closer to a flat side 15 of container 12. Flat side 15 may include a display panel such as a product packaging information label or logo, for example. Closure 14 and/or dispensing outlet 44 may be provided such that it is oriented in one position relative to flat side 15 every time and/or locked into place such that rotational removal is inhibited or prevented. Instead of or in addition to locating dispensing outlet 44 relative to flat side 15, dispensing outlet may be oriented in one position as discussed above relative to a pour handle or the like. In some embodiments, dispensing outlet 44 and/or closure 14 may be oriented in another position relative to container 12, such as opposite flat side 15 or some other feature of container 12, for example. Contents 140 of container 12, such as liquid or flowable contents, for example, may gravitate toward flat or bottom side 15 when container 12 is oriented such that it is resting on flat side 15. Annular ring 23 and/or dispensing outlet 44 may be provided such that it is proximate the flat side 15 and/or at the bottom area of the closure 14 when oriented with flat side 15 on the bottom relative to gravity or other force biasing contents 140 toward flat side 15. Closure 14 may be provided as discussed above to ensure that annular ring 23 and/or dispensing outlet 44 is always located proximate flat side 15, for example, to facilitate with complete extraction or evacuation of contents 140 from container 12. It is understood that contents 140 may be provided in such a way to freely flow out of dispensing outlet 44 and/or to be removed or evacuated with an external mechanism and/or external force, such as a pump or suction device.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A package comprising:

a container including a container body having a sidewall and a floor coupled to a lower end of the sidewall, a filler neck coupled to an upper end of the sidewall and spaced apart from the floor, and a closure anchor unit coupled to the filler neck, the closure anchor unit including an exterior thread coupled to an exterior surface of the filler neck and having a first end and a second end spaced apart from the first end in a vertical direction, a first closure anchor coupled to the exterior surface of the filler neck and the exterior thread and located circumferentially between the first end and the second end, and a second closure anchor aligned with the first closure anchor in the vertical direction and spaced apart from the first closure anchor in a circumferential direction to reside on an opposite side of the filler neck from the first closure anchor, and a closure including a top wall formed to include a product-dispensing outlet, an annular skirt coupled to the top wall and extending in a downward direction away from the top wall, and a closure retainer unit coupled to the annular skirt, the closure retainer unit including an interior thread coupled to an inner surface of the annular skirt and configured to engage with the exterior thread during installation of the closure on the filler neck of the container, a first closure retainer configured to engage with the first closure anchor to block rotation of the closure relative to the filler neck, and a second closure retainer configured to engage with the second closure anchor to block rotation of the closure relative to the filler neck, wherein the product-dispensing outlet is offset from a central axis of the closure toward the first closure retainer and the first closure anchor to align the product-dispensing outlet with the first closure retainer and the first closure anchor at a predetermined circumferential orientation relative to the container.

2. The package of claim 1, wherein the closure anchor unit further includes a first set of recesses coupled to the exterior surface of the filler neck and spaced apart circumferentially from the first closure anchor and the second anchor, and the closure retainer unit further includes a first set of projections coupled to the inner surface of the annular skirt and spaced apart circumferentially from the first closure retainer and the second closure retainer, each projection included in the first set of projections are configured to extend into a respective recess included in the first set of recesses when the closure is installed on the container.

3. The package of claim 2, wherein the closure anchor unit further includes a second set of recesses coupled to the exterior surface of the filler neck and spaced apart circumferentially from the first closure anchor, the second anchor and the first set of recesses, and the closure retainer unit further includes a second set of projections coupled to the inner surface of the annular skirt and spaced apart circumferentially from the first closure retainer, the second closure retainer, and the first set of projections, each projection included in the second set of projections are configured to extend into a respective recess included in the second set of recesses when the closure is installed on the container.

4. The package of claim 3, wherein the first and second sets of recesses and the first and second sets of projection are located below the first and second closure anchors and below the first and second closure retainers relative to the top wall.

5. The package of claim 3, wherein each recess is defined at least partially by a ramped surface angled relative to the exterior surface of the filler neck to extend in a closure-installation direction and a radial surface arranged to extend radially outward away from and perpendicular to the exterior surface of the filler neck, and wherein each projection includes a ramped surface angled to the interior surface of the annular skirt to extend in the closure-installation direction to engage with the ramped surface of at least one recess during installation of the closure on the container and a radial surface arranged to extend radially inward away from and perpendicular to the interior surface of the annular skirt to engage with the radial surface of one of the recesses after installation of the closure on the container to block removal of the closure from the filler neck.

6. The package of claim 3, wherein the closure anchor unit and the closure retainer unit provide means for retaining the closure on the filler neck of the container in an installed position to block removal of the closure without damaging the closure and for orienting the product-dispensing outlet in a predetermined orientation relative to the container to cause the product-dispensing outlet to be maintained in the predetermined orientation after a first instance of installation of the closure on the container in the installed position.

7. The package of claim 2, wherein a first recess included in the first set of recesses is spaced 90 degrees from the first and second closure anchors and all other recesses included in the first set of recesses are spaced less than 90 degrees from the first closure anchor and greater than 90 degrees from the second closure anchor.

8. The package of claim 3, wherein a first recess included in the first set of recesses is spaced 90 degrees from the first and second closure anchors and all other recesses included in the first set of recesses are spaced less than 90 degrees from the first closure anchor and greater than 90 degrees from the second closure anchor, and wherein a first recess included in the second set of recesses is spaced 90 degrees from the first and second closure anchors and all other recesses included in the second set of recesses are spaced less than 90 degrees from the second closure anchor and greater than 90 degrees from the first closure anchor.

9. The package of claim 1, wherein the filler neck includes a neck body coupled to the upper end of the container body and a neck ring coupled to an exterior surface of the neck body and arranged to extend annularly around the neck body and to engage the annular skirt and block deformation of the annular skirt relative to the container when the closure is installed on the container.

10. The package of claim 9, wherein the closure anchor unit further includes a first set of recesses formed in the neck ring of the filler neck and spaced apart circumferentially from the first closure anchor and the second anchor, and the closure retainer unit further includes a first set of projections coupled to the inner surface of the annular skirt and spaced apart circumferentially from the first closure retainer and the second closure retainer, each projection included in the first set of projections are configured to extend into a respective recess included in the first set of recesses when the closure is installed on the container.

11. The package of claim 10, wherein the closure anchor unit further includes a second set of recesses coupled to the neck ring of the filler neck and spaced apart circumferentially from the first closure anchor, the second anchor and the first set of recesses, and the closure retainer unit further includes a second set of projections coupled to the inner surface of the annular skirt and spaced apart circumferentially from the first closure retainer, the second closure retainer, and the first set of projections, each projection included in the second set of projections are configured to extend into a respective recess included in the second set of recesses when the closure is installed on the container.

12. A package comprising:

a filler neck, a closure anchor unit coupled to the filler neck, the closure anchor unit including an exterior thread coupled to an exterior surface of the filler neck and having a first end and a second end spaced apart from the first end in a vertical direction, a closure anchor coupled to the exterior surface of the filler neck, and a set of recesses formed into the exterior surface of the filler neck and spaced circumferentially from the closure anchor, and a closure configured to be installed on the filler neck and including a top wall formed to include an aperture, an annular skirt coupled to the top wall and extending in a downward direction away from the top wall, and a closure retainer unit coupled to the annular skirt, the closure retainer unit including an interior thread coupled to an inner surface of the annular skirt and configured to engage with the exterior thread during installation of the closure on the filler neck, a closure retainer configured to engage with the closure anchor during installation of the closure on the filler neck in an installation direction to block rotation of the closure relative to the filler neck in the installation direction and an opposite removal direction, and a set of projections coupled to the inner surface of the annular skirt and spaced circumferentially from the closure retainer, each projection included in the set of projections configured to engage with a respective recess included in the set of recesses to block rotation of the closure relative to the filler neck in the removal direction.

13. The package of claim 12, wherein the aperture formed in the top wall is offset from a central axis of the closure toward the closure retainer and the closure anchor to align the aperture with the closure retainer and the closure anchor at a predetermined circumferential orientation relative to the filler neck.

14. The package of claim 12, wherein the closure anchor unit further includes a second closure anchor aligned with the closure anchor in the vertical direction and spaced apart from the closure anchor in a circumferential direction to reside on an opposite side of the filler neck from the closure anchor and locate the set of recesses and the set of projection circumferentially between the closure anchor and the second closure anchor, and wherein the closure retainer unit further includes a second closure retainer configured to engage with the second closure anchor to block rotation of the closure relative to the filler neck when the closure is installed on the filler neck.

15. The package of claim 14, wherein the closure anchor unit further includes a second set of recesses coupled to the exterior surface of the filler neck and spaced apart circumferentially from the closure anchor, the second anchor and the set of recesses, and the closure retainer unit further includes a second set of projections coupled to the inner surface of the annular skirt and spaced apart circumferentially from the closure retainer, the second closure retainer, and the set of projections, each projection included in the second set of projections are configured to extend into a respective recess included in the second set of recesses when the closure is installed on the filler neck.

16. The package of claim 12, wherein the set of recesses span a first circumferential length around the filler neck and the set of projections span a second circumferential length around annular skirt, the first circumferential length is less than half of a circumference of the filler neck and the second circumferential length is less than half of a circumference of the annular skirt.

17. The package of claim 16, wherein the closure anchor unit further includes a second set of recesses coupled to the exterior surface of the filler neck and spaced apart circumferentially from the closure anchor, the second anchor, and the set of recesses, and the closure retainer unit further includes a second set of projections coupled to the inner surface of the annular skirt and spaced apart circumferentially from the closure retainer, the second closure retainer, and the set of projections, each projection included in the second set of projections are configured to extend into a respective recess included in the second set of recesses when the closure is installed on the filler neck, and wherein the second set of recesses span the first circumferential length around the filler neck and the set of projections span the second circumferential length around annular skirt.

18. The package of claim 12, wherein the filler neck includes a neck body and a neck ring coupled to an exterior surface of the neck body and arranged to extend annularly around the neck body and to engage the annular skirt and block deformation of the annular skirt relative to the filler neck when the closure is installed on the filler neck, and wherein the set of recesses are formed in the neck ring of the filler neck.

19. The package of claim 18, wherein the closure anchor unit further includes a second set of recesses formed in the neck ring of the filler neck and spaced apart circumferentially from the closure anchor, the second anchor, and the set of recesses, and the closure retainer unit further includes a second set of projections coupled to the inner surface of the annular skirt and spaced apart circumferentially from the closure retainer, the second closure retainer, and the set of projections, each projection included in the second set of projections are configured to extend into a respective recess included in the second set of recesses when the closure is installed on the filler neck.

20. The package of claim 12, wherein the closure is configured to change from an uninstalled configuration separated from the filler neck of the container, to a partially-installed configuration at a first angular orientation relative to the filler neck, in which at least one of the projections extends into a corresponding recess and the closure retainer is spaced circumferentially from the closure anchor, and to a fully-installed configuration at a second angular orientation relative to the filler neck, in which at least two projections extend into corresponding recesses and the closure retainer engages the closure anchor.

* * * * *